United States Patent [19]

Filsinger

[11] 4,453,516

[45] Jun. 12, 1984

[54] DEVICE FOR CONTROLLING AN INTERNAL COMBUSTION ENGINE

[75] Inventor: Reinhard Filsinger, Wernau, Fed. Rep. of Germany

[73] Assignee: Daimler-Benz Aktiengesellschaft, Fed. Rep. of Germany

[21] Appl. No.: 266,136

[22] Filed: May 22, 1981

[30] Foreign Application Priority Data

May 22, 1980 [DE] Fed. Rep. of Germany ..... 3019562

[51] Int. Cl.[3] ..... F02D 1/18

[52] U.S. Cl. ..... 123/340; 123/352; 123/357; 123/399; 123/400

[58] Field of Search ..... 123/352, 353, 354, 340, 123/399, 400, 478, 480, 486–488, 357, 361; 180/178, 179

[56] References Cited

U.S. PATENT DOCUMENTS

| | | | |
|---|---|---|---|
| 3,645,366 | 2/1972 | Numazawa et al. | 123/340 |
| 3,750,632 | 8/1973 | Zechnall | 123/488 |
| 3,960,120 | 6/1976 | Aono et al. | 123/487 X |
| 4,117,903 | 10/1978 | Fleischer et al. | 123/352 X |
| 4,245,312 | 1/1981 | de Vulipillieres | 123/486 X |
| 4,301,883 | 11/1981 | Collonia | 123/352 |

FOREIGN PATENT DOCUMENTS

| | | | |
|---|---|---|---|
| 2009968 | 6/1979 | United Kingdom | 123/352 |

*Primary Examiner*—William A. Cuchlinski, Jr.
*Attorney, Agent, or Firm*—Craig & Burns

[57] ABSTRACT

A device for controlling the throttle valve of an internal combustion engine accepts input signals representative of vehicle velocity, gearshift position and roadway temperature which by logic means generates a first signal which is employed to modify a second signal received from a desired value generator which is under the control the gas pedal, the signal so modified being employed to control the throttle valve or injection pump position for the internal combustion engine wherein at idling speeds a large change in the accelerator pedal position effects a small change in the throttle valve position which control changes to effect an increasingly degressive transfer characteristic wherein a small change in accelerator pedal position effects a large change in throttle valve position as the vehicle velocity increases to a high velocity.

34 Claims, 6 Drawing Figures

FIG. 1
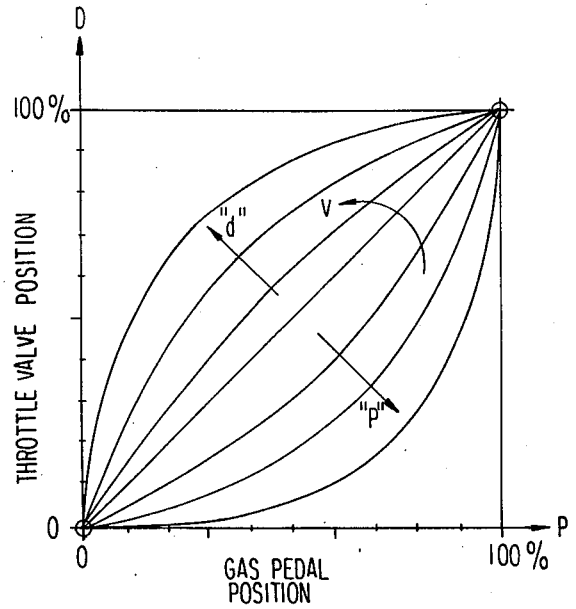
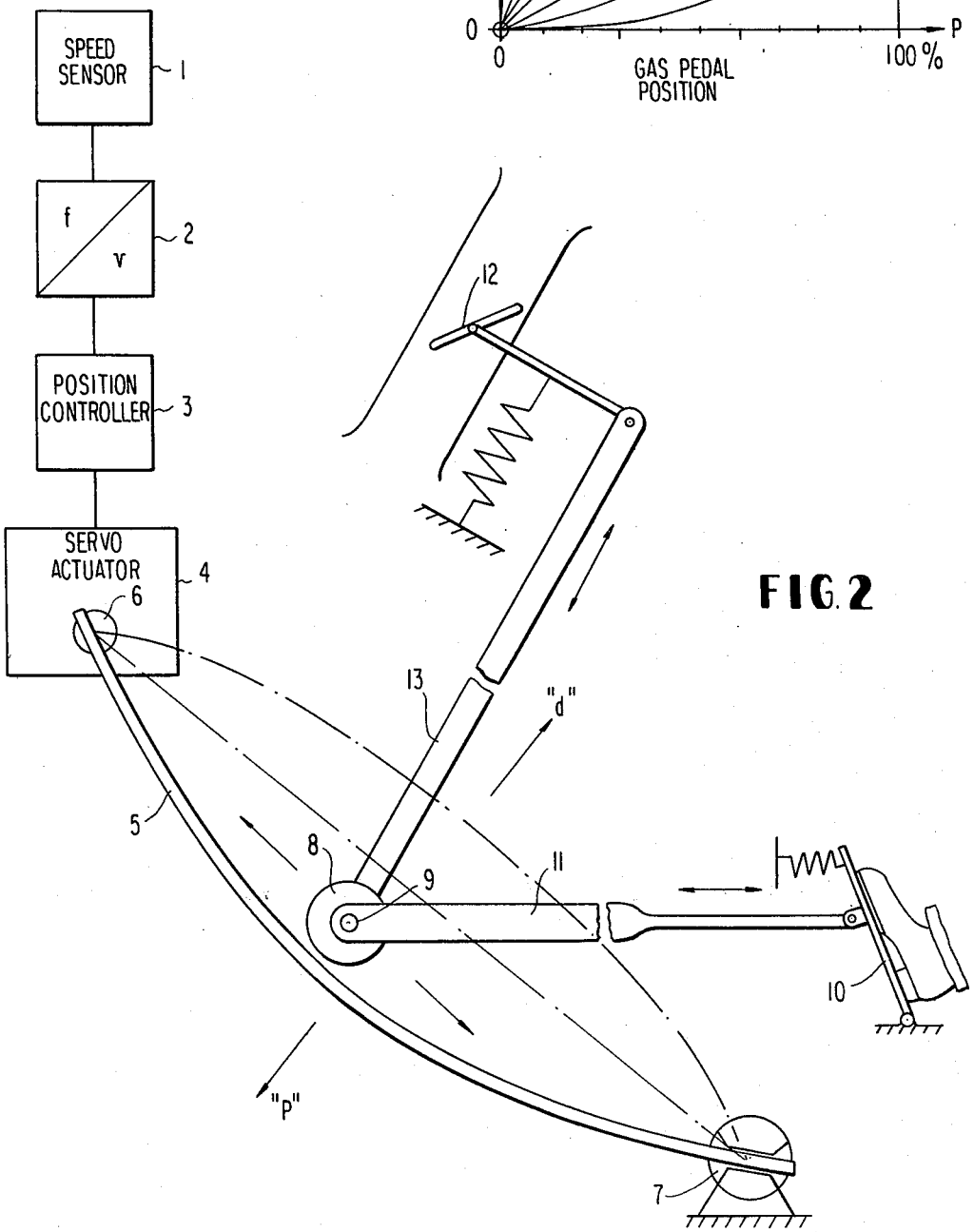
FIG. 2

DEVICE FOR CONTROLLING AN INTERNAL COMBUSTION ENGINE

The invention relates to a device for controlling the throttle valve position or the injection pump position, respectively, of an internal combustion engine, especially for automotive vehicles with a gas pedal.

In conventional designs of the connection between the gas pedal and the throttle valve or other power-regulating devices associated with the engine in automotive vehicles, the curve of the transfer characteristic, though constructionally selectable in certain limits, is finally fixed after construction is completed. Due to very different requirements to be met by the curve of the transfer characteristic in various situations, such as starting in lowermost gear, acceleration at medium and high speeds, etc., a fixed transfer characteristic can merely serve as a rather inadequate compromise.

The aim underlying the present invention essentially renders in providing a device capable of adapting the transfer characteristic of the connection between the gas pedal and the throttle valve or injection pump to the respective requirements and of varying this characteristic accordingly.

In accordance with the present invention, a function generator is provided which sets the correlation of the throttle valve position or injection pump position with the position of the gas pedal according to a function changeable by a regulating or correcting variable. The most important variable for changing the characteristic curve is considered to be the vehicle velocity with which the regulating variable is correlated, but this value can be affected by further variables, such as gear-shift position, roadway temperature, etc.

It is thus possible, for example, during a startup of very high-powered vehicles to realize a very progressive characteristic and at high velocity a less progressive to degressive characteristic. Last, but not least, such a changing of the characteristic would also be of advantage for a fuel-conserving driving mode.

In accordance with a feature of the invention there is provided a device for controlling the throttle valve position or the injection pump position, respectively, of an internal combustion engine, especially for automotive vehicles with a gas pedal, wherein a function generator is provided which presets the correlation of the throttle valve position or injection pump position with the position of the gas pedal in accordance with a function which can be changed by a regulating or correcting variable which is associated with the vehicle velocity and can be changed with a factor associated with at least one further variable.

The further variable may be associated with the gear-shift position. The regulating variable can also be changed with a factor associated with an additional variable associated with the roadway temperature.

Another feature of the invention is characterized in that a function generator is constituted by a steel spring, one end of which is mounted to be rotatable, and the other end of which is mounted to be rotatable and axially displaceable, wherein at least one end is turned by a regulating element provided with a geared motor in dependence on the regulating variable in such a way that the steel-leaf spring forms, depending on the flexing direction, a curve with a course running from progressive via linear to degressive, along which curve is guided the linkage between the gas pedal and the throttle valve with one of its joints.

Alternatively, the function generator of the present invention may be an operational amplifier, the noninverting input of which can be fed with an electrical signal associated with the gas pedal position, and from the output of which extend two parallel-connected voltage dividers, with a dividing ratio variable by the regulating value, to the reference potential of the circuit, wherein the tap of the first voltage divider is connected to the inverting input of the operational amplifier and the tap of the second voltage divider is connected to the regulating element of the throttle valve or of the injection pump, respectively.

Additionally, according to the present invention, two voltage dividers may be disposed between an amplifier output and a tap and may consist respectively of one ohmic resistor and between tap and reference potential of respectively one photosensitive resistor, on which is effective a lamp common to both, with a luminosity correlated with the regulating variable. A diode current-conductive toward the reference potential is connected in the first voltage divider between the photosensitive resistor and the reference potential.

A further feature of the invention resides in connecting in a first voltage divider, between an amplifier output and a tap, a series circuit of a first photosensitive resistor with a diode current-conductive toward the tap, and a series circuit of a second photosensitive resistor with a diode current-conductive toward the reference potential between the tap and the reference potential. One resistor is respectively connected in parallel to both series circuits and a first photosensitive resistor is connected in the second voltage divider between the amplifier output and the tap, with a second photosensitive resistor being connected between the tap and the reference potential. A luminosity of a first lamp acts on the two first photosensitive resistors of both voltage dividers, with the luminosity of a second lamp acting on the two second photosensitive resistors of both voltage dividers. Both lamps are connected on one side with each other and to an adjustable voltage $U_M$ and on the other side with respectively one diode in series connection to the input of the regulating variable, wherein the first diode is current-conductive in the direction from the first lamp to the input of the regulating variable and the second diode is current-conductive from the input of the regulating variable to the second lamp.

Accordingly, it is an object of the present invention to provide a control for an internal combustion engine which avoids, by simple means, the shortcomings and disadvantages encountered in the prior art due to fixed transfer characteristics.

Another object of the present invention resides in providing a control for the throttle valve of an internal combustion engine wherein the transfer characteristic between gas pedal and throttle valve is continually variable.

Yet another object of the present invention resides in providing a control for a throttle valve which modifies the transfer characteristic between gas pedal and throttle valve in accordance with the vehicle velocity.

Another object of the present invention resides in providing a control for a throttle valve which modifies the transfer characteristic between gas pedal and throttle valve in accordance with the vehicle velocity further modified by an additional variable.

Still another object of the present invention resides in providing a control for the throttle valve of an internal combustion engine which modifies the transfer characteristic between gas pedal and throttle control in accordance with gearshift position.

A still further object of the present invention resides in providing a control for a throttle valve of an internal combustion engine which modifies the transfer characteristic between gas pedal and throttle valve in accordance with roadway temperature.

A still further object of the invention is the provision of a control for a throttle valve which adjusts the transfer characteristic in various situations such as low gear, acceleration at medium and high speeds and the like.

These and other objects, features, and advantages of the present invention will become more apparent from the following description when taken in connection with the accompanying drawings which show, for the purposes of illustration only, several embodiments in accordance with the present invention, and wherein:

FIG. 1 is a diagram showing the connection between gas pedal and throttle valve;

FIG. 2 is a partially schematic view of a first embodiment of a control for an internal combustion engine constructed in accordance with the present invention, with a mechanical transfer;

Figure 3:
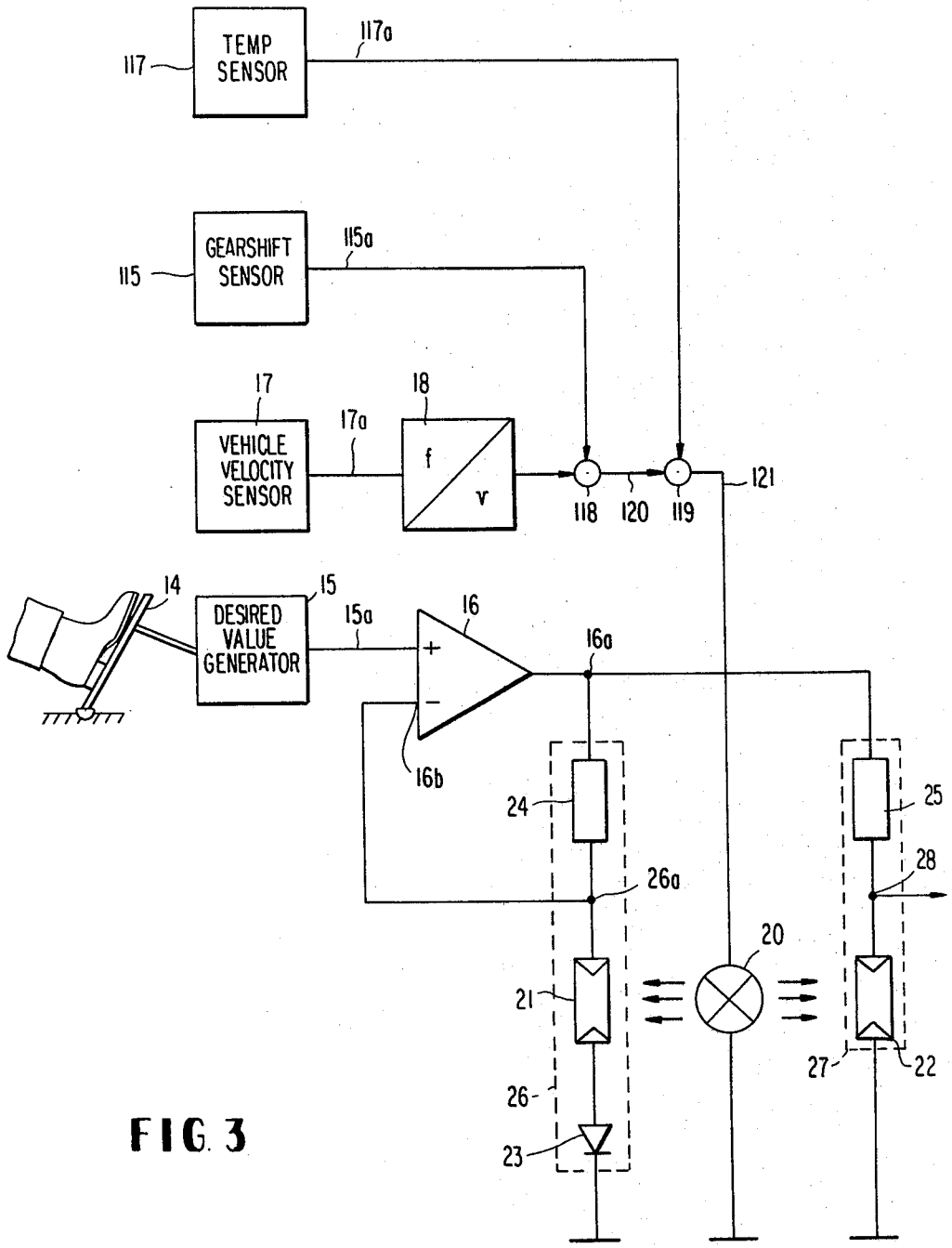
FIG. 3 is a partially schematic view of a second embodiment of a control for an internal combustion engine constructed in accordance with the present invention, with an electronic-optical transfer.

Referring now to the drawings wherein like reference numerals are used throughout the various views to designate like parts and, more particularly to FIG. 1, according to this figure, various transfer curves between the gas pedal position and throttle valve position are illustrated, with the abscissa shows the position of the gas pedal P from inoperative (0) to full acceleration (100%), and the ordinate shows the position of the throttle valve D from idling position (0) to fully opened (100%). Starting with the straight, solid line, representing a linear transfer characteristic, the curves shown underneath this straight line exhibit a course which is increasingly progressive in the direction of arrow "p" and the curves illustrated above this straight line have a course which becomes increasingly degressive in the direction of arrow "d".

A progressive characteristic prevails if, in the initial region, a large change in the gas pedal position is associated with a small change in the throttle valve position. Exactly the converse is true in case of a degressive characteristic. All curves have in common the initial point and the end point in the idling and fully accelerated position of the gas pedal, respectively.

Depending on the vehicle speed, the transfer characteristic is to be varied—for example, from very progressive during starting via linear at medium speed up to very degressive at high velocity, which is indicated by the curved arrow "v".

FIG. 2 provides an example of a first embodiment of the invention and, according to this figure, a conventional speed pickup 1 with a signal output having a frequency proportional to the vehicle velocity actuates a frequency-voltage converter 2 which, in turn, yields a signal having a voltage representing the desired value for a conventional position controller 3. The position controller (servo transmitter) 3 translates the voltage input thereto into a signal representing a desired position to be imparted to axle 6. A likewise conventional regulating element (servo actuator) 4 is connected to the position controller 3 to receive the signal therefrom to translate the signal input from controller 3 into a position for axle 6, by conventional kinematic mechanical transfer elements.

In the illustrated arrangement, a steel-leaf spring 5, one end of which is fixedly joined to the axle 6 of the regulating element, and which is guided in the vicinity of the other end to be longitudinally displaceable in a rotatable bearing 7, is bent into various shapes by the rotation of the axle 6 of the regulating element under control of servo actuator 4.

A roller 8 slides along the steel-leaf spring 5; the axle 9 of this roller is connected to the rod 11, which is a link to the gas pedal 10, as well as to the rod 13 leading to the throttle valve 12 in such a way that the two rods 11 and 13 can be rotated with respect to each other.

With the shape of the steel-leaf spring 5 being linear, an approximately linear relation exists between the path of the rods 11 and 13. If the steel-leaf spring 5 is bent toward side "p" by the regulating element 4, progression is produced, and if the spring is bent toward side "d", degression is produced in the transfer characteristic between the gas pedal 10 and the throttle valve 12.

FIG. 3 illustrates the dependency of the characteristic on the vehicle velocity by the circuit described hereinbelow having a conventional follow-up control with an "electronic gas pedal". A gas pedal 14 acts on a desired-value (set-point) generator 15, the output signal **15*a* of which is fed to the noninverting input of the operational amplifier 16**.

Two parallel-connected voltage dividers 26 and 27 lead from the output of the operational amplifier 16 to the reference potential of the circuit. In the first voltage divider 26, a resistor 24 is connected between the amplifier output 162 and the tap **26*a*, and a series circuit of a photosensitive resistor 21 with a diode 23 current-conductive toward the reference potential is connected between the tap 26*a* and the reference potential. In the second voltage divider, a resistor 25 is connected between the amplifier output and the tap 28, and a photosensitive resistor 22 is connected between the tap 28 and the reference potential. The tap 26*a* of the first voltage divider 26 is connected to the inverting input 16*b* of the operational amplifier 16; the tap 28 of the second voltage divider 27** leads to a regulating element of the throttle valve, which element is not illustrated.

The signal from a driving velocity sensor 17, namely a signal with frequency proportional to the driving speed, is converted in a frequency-voltage converter 18 into an analogous electrical value, namely the regulating variable, for example into a d.c. voltage which is applied to a lamp 20. The luminosity of this lamp acts on the two photosensitive resistors 21, 22 of the two voltage dividers 26 and 27. This regulating variable can be influenced by additional values, schematically indicated at 118 and 119, for example the gearshift position and the roadway temperature.

While such influence may be achieved by a variety of circuits, those familiar with the art will recognize that such can be achieved, for example, by means of a gearshift sensor 115 which senses the position of the gearshift to generate a signal at 115*a*.

An analog logic operator 118 accepts the d.c. voltages from 18 and 115*a* to produce an output signal at 120 which represents a modification of the velocity signal as effected by the gearshift signal. This modification may take the form of a mathematical function. In the exemplary form shown, this modification is disclosed as a multiplier of the velocity signal.

A roadway temperature sensor 117 generates a d.c. voltage on output 117*a* which may be used to modify the output 120 by means of an analog logic operator 119. The modification may take the form of a mathematical function. In the exemplary form shown, this is disclosed as a multiplier of the output on line 120. The output 121 of the analog logic device 119 thus constitutes the d.c. voltage applied to lamp 20.

Those skilled in the art will recognize that while the modifications performed by operators 118 and 119 are disclosed as multipliers, which may be less or greater than one (1), the modifications in question may take other mathematical forms as circumstances may require.

The feedback of the operational amplifier 16 is determined by the first voltage divider 26.

While the voltage divider 26 generates a nonlinear feedback in dependence on the luminosity of the lamp 20 and thus essentially in dependence on the vehicle velocity, the second voltage divider 27 serves for amplification compensation by exhibiting a suitable dimension.

The desired value, effected by the circuit according to this invention, is derived from the tap 28 and fed to the regulating element, not shown, for the throttle valve.

By the inversely proportional characteristic of the frequency-voltage converter 18, a progression is obtained between the gas pedal and the throttle valve which becomes increasingly weaker with increasing vehicle speed.

A change in the transfer characteristic can be produced with the aforedescribed circuit either by a suitable construction of the desired-value generator 15 at the gas pedal 14 or of the actual-value generator in the regulating element (not shown) and/or of the characteristics of both generators, from "progressive" via "linear" to "degressive".

According to the invention, the dependency of the transfer characteristic on the regulating variable is freely selectable within wide limits by the choice of the following parameters:

1. Configuration of the characteristic 19 of the frequency-voltage converter 18.
2. Optical data of the incandescent lamp/light-emitting diode 20.
3. Optical coupling between incandescent lamp/light-emitting diode 20 and photosensitive resistor 21.
4. Dimensioning of the voltage divider 26.

Figure 4:
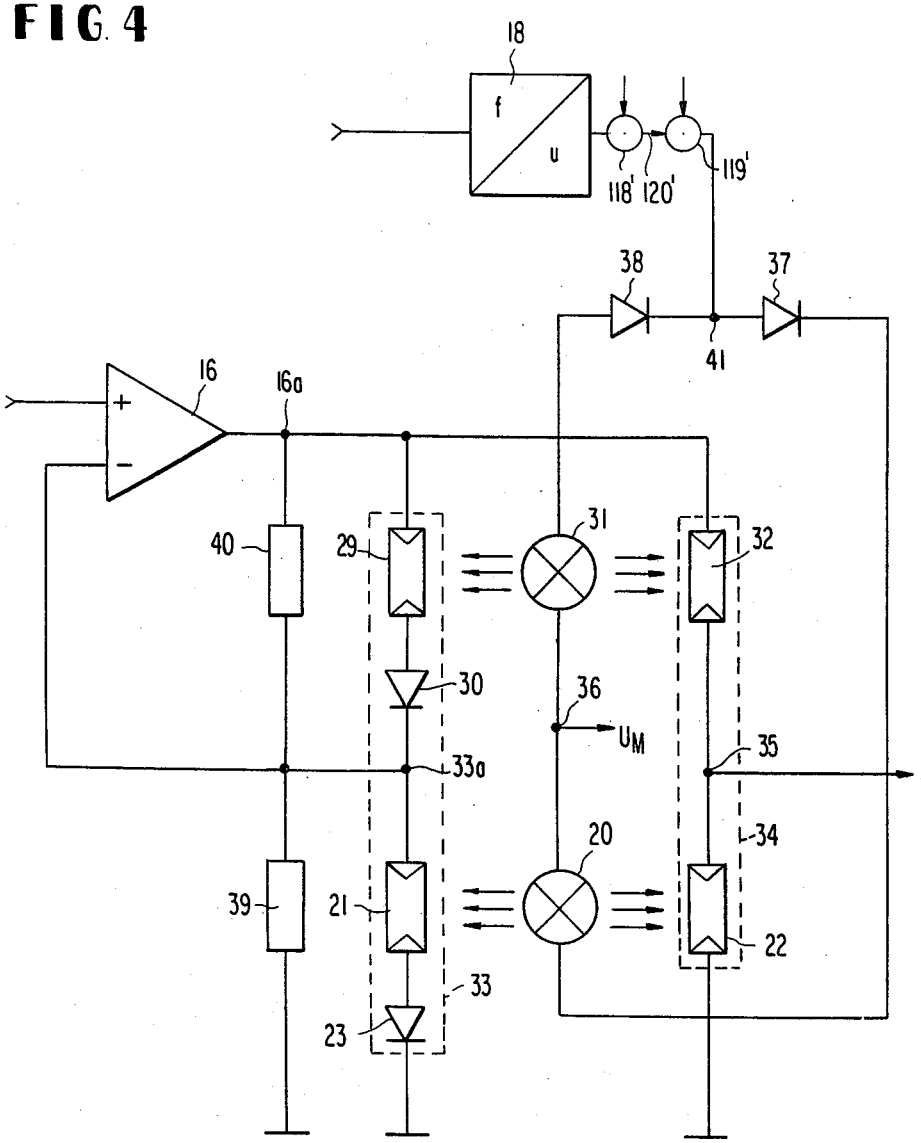
FIG. 4 is a partially schematic view of another embodiment of a control for an internal combustion engine constructed in accordance with the present invention with an electronic-optical transfer similar to FIG. 3.

FIG. 4 is an example of a control arrangement of FIG. 3, with a mode of operation which is the same, in principle, as the first embodiment, the realization of even degressive characteristics is obtained by electronic means.

The difference between the arrangement of FIG. 4 and FIG. 3 resides in the construction of the two voltage dividers and in the actuation of the photosensitive resistors. In the first voltage divider 33, a series circuit of a first photosensitive resistor 29 with a diode 30 current-conductive toward the tap is connected between the amplifier output 162 and the tap 33*a*, and a series circuit of a second photosensitive resistor 21 with a diode 23 current-conductive toward the reference potential is connected between the tap 33*a* and the reference potential. Respectively, one resistor 39, 40 is connected in parallel to both series circuits. In the second voltage divider 34, a first photosensitive resistor 32 is connected between the amplifier output and the tap 35, and a second photosensitive resistor 22 is arranged between the tap 35 and the reference potential.

The luminosity of a first lamp 31 acts on the two first photosensitive resistors 29, 32 of both voltage dividers 33, 34, and the luminosity of a second lamp 20 acts on the two second photosensitive resistors 21, 22 of both voltage dividers. Both lamps 20, 31 are connected to each other on one side and to an adjustable voltage $U_M$ and are connected on the other side at tap 41, with respectively one diode 37, 38 in series connection, to the input of the regulating variable, the d.c. voltage representing velocity input from 18, wherein the first diode 38 is current-conductive in the direction from the first lamp 31 to the input of the regulating variable from 18, and the second diode 37 is current-conductive from the input of the regulating variable to the second lamp 20.

It will be appreciated that the voltage input from 18 at tap 41 in FIG. 4 may be modified in accordance with one or more variables such as gearshift position and roadway temperature as shown at 118' and 119' employing elements such as 118 and/or 119 as shown in FIG. 3.

By the choice of the value for voltage $U_M$ between the reference potential and the maximum value of the regulating variable from 18, the transition is determined from the progressive into the degressive control region.

If the regulating variable from 18 is larger than $U_M$, then a current flows through the diode 37 and the incandescent lamp/light-emitting diode 20, while the diode 38 is nonconductive. Due to the optical coupling with the photosensitive resistor 21, a nonlinear feedback is obtained, leading to progressive control. However, if the regulating variable from 18 is smaller than $U_M$, then the diode 37 is nonconductive, and the previously blocked diode 38 becomes conductive.

Current flows through the lamp/light-emitting diode 31. Due to the optical coupling with the photosensitive resistor 29, a likewise nonlinear feedback is obtained, but on account of the arrangement of the photosensitive resistor 29 and the diode 30 within the voltage divider 33, this leads to a degressive control.

The voltage divider 34, consisting of the photosensitive resistors 22 and 32, here again serves for amplification compensation.

The voltage divider consisting of resistors 39 and 40 serves for maintaining feedback if the voltage of the frequency-voltage converter 18 is equal to or similar to the voltage $U_M$ at point 36.

At point 35, the desired value effected by the circuit of this invention is derived and transmitted to the regulating element of the throttle valve.

Additional embodiments of the invention are possible. For example, in place of the steel-leaf spring, a rotatable three-dimensional cam can also be utilized.

It is also feasible to effect the transfer operation by use of a microprocessor control system and, for this purpose, an arrangement such as that shown in FIGS.

5A–B may be employed. Desired value sensor 15 and temperature sensor 117 provide analog voltage inputs, D and T, on lines 15*a* and 117*a*, respectively.

Figure 5A:
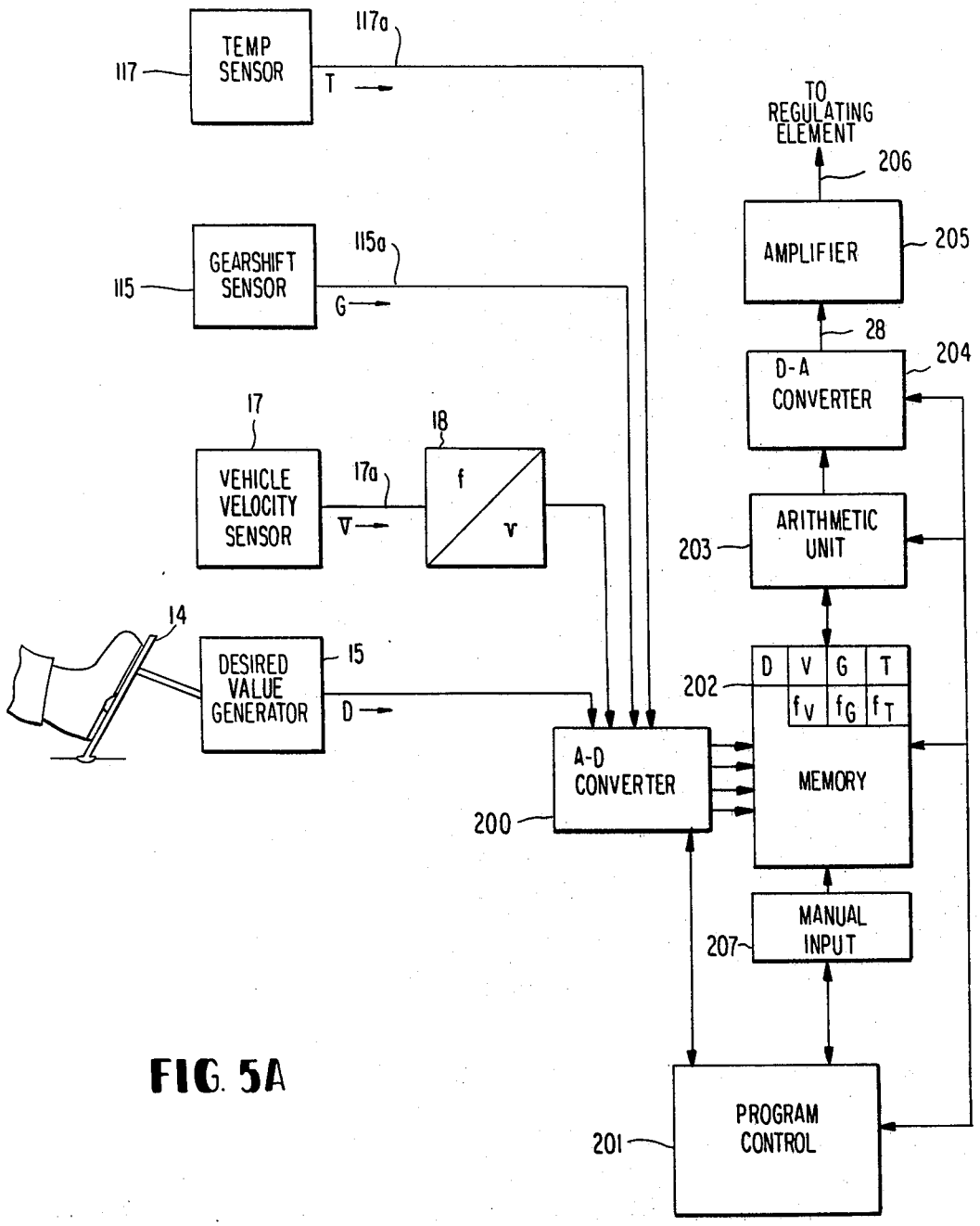
FIG. 5A is a partially schematic view of yet another embodiment of a control for an internal combustion engine constructed in accordance with the present invention employing a microprocessor.

As in the arrangement configuration of FIG. 5A, the signal output from the vehicle velocity sensor 17, an output line 17*a*, respectively, is translated to analog voltage in the frequency/voltage converter 18, to provide analog voltage. Analog to digital converter 200 serves to translate the respective analog voltage inputs into digital form under control of the program control 201. In such a configuration, the program control 201 may cause sequential polling of the inputs from the respective sensors to sample the voltages then existing at the sensor. This may take place repetitively to present a continuous series of inputs from the respective sensors in digital form at the output of the analog digital converter. Alternatively, a–d converter 200 may consist of a plural a–d converters, each dedicated to translating an input for each of the respective sensors 15, 17, 115 and 117.

The program control 201 directs the storage in memory 202 of the data recently sensed which is to be made available in the subsequent arithmetic operations.

Memory 202 also includes storage for certain scaling factors to be used in the computation as will be explained below.

Arithmetic unit 203 serves to perform, under the control of program control 201, logic operations which are analogous to the circuitry shown in FIG. 3, for example, logic elements 118 and 119 and the configuration of circuitry consisting of operational amplifier 16, frequency dividers 26 and 27 and their attendant circuitry.

The output of arithmetic unit 203 is translated in digital to analog converter 204 to an analog signal which is amplified in amplifier 205 to produce an output 206 to be fed to the regulating element.

Manual input 207 may be constituted by a keyboard accessible to the vehicle operator at the vehicle controls. By this element, the program to be employed by the microprocessor control system may be input along with scaling factors and data useful in the program. Alternatively, the program may be stored, for example, in a read-only memory (ROM) at the factory, which may be programmable (PROM) or erasable/programmable (EPROM).

Figure 5B:
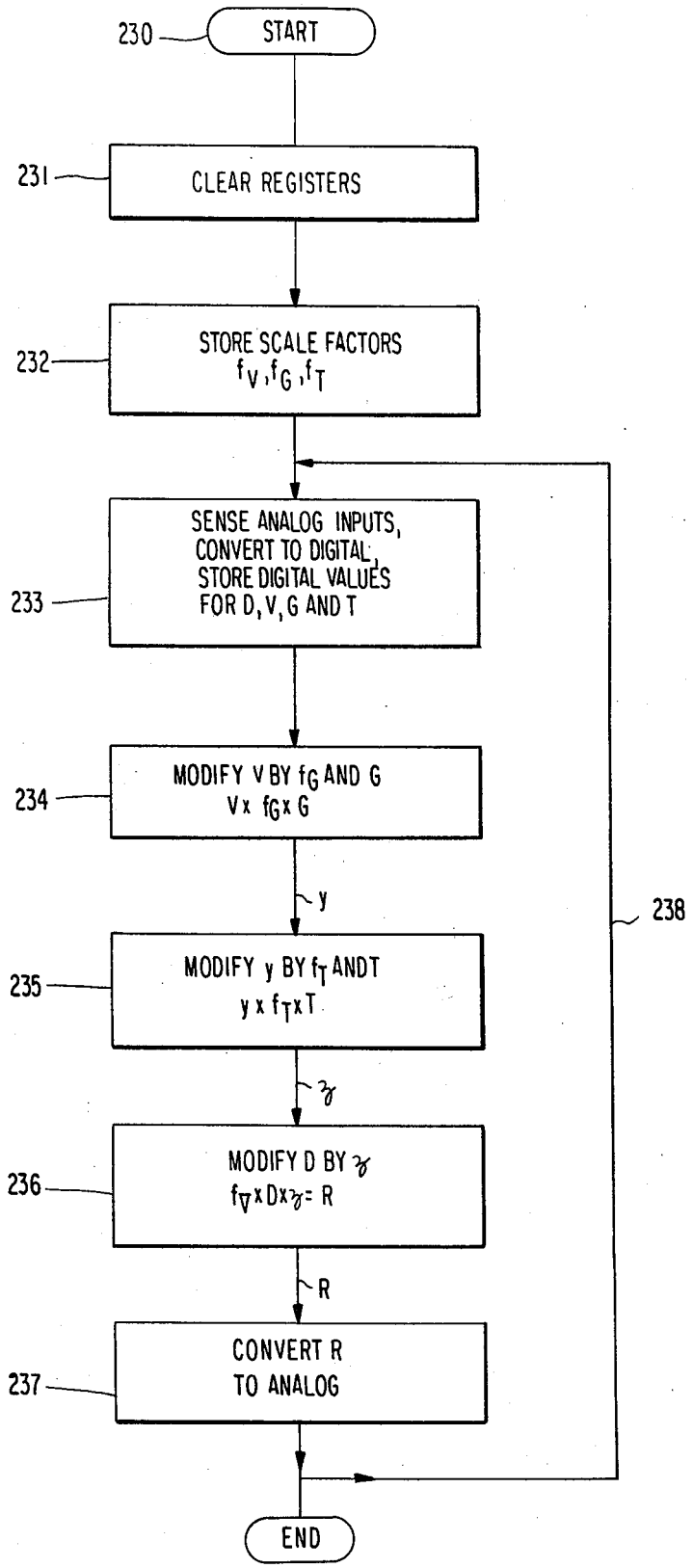
FIG. 5B is a flow chart of the embodiment of FIG. 5A.

Attention is directed to FIG. 5B which discloses a program which may be employed by the microprocessor control system. At the start of the program 230, all registers are cleared in the microprocessor at 231 and, at step 232, scale factor values to be used in the computation are stored in memory 202. These may be input via manual input 207 or may be input at the factory in a ROM.

As is well known to those skilled in the art, calibration of individual parameters may be necessary. The scaling factors serve to effect this purpose. They may be determined by past performance. Initially, they may be assumed to have a value of one (1). They may also serve to select the transfer characteristic as explained in connection with FIG. 3.

A scale factor $f_v$ is stored which serves to scale the output on line 15*a* from a desired value generator 15 to the necessary output at line 28.

Scale factor $f_G$ is employed to adjust the value of the gearshift sensor for use in the arithmetic calculations.

Similarly, a scale factor $f_T$ performs a scaling operation for the temperature sensor.

At 233, the program control causes the sequential sensing of analog inputs from sensors 15, 17, 115, and 117 as they appear at the input of the analog digital conversion unit 200, and the storing of the digital output of the sensors in memory 202.

At this point, data representing the desired value D, vehicle velocity V, gearshift position G, and temperature T are stored together with the necessary scaling factors in memory in preparation for arithmetic operations.

At step 234, the program control 201 withdraws digital values for the gearshift sensing G and the comparable scale factor $f_G$ and the vehicle velocity and multiplies them together. This step produces an output comparable to that of the step performed at logic element 118 in FIG. 3. At step 235, digital values for sensed temperature T and the comparable scale factor therefor $f_T$ are withdrawn from memory multiplied together ($f_T \times T$), and the product is multiplied with the output derived in block 234. This step produces an output comparable to the logic operation performed by logic element 119 in FIG. 3 so that the output of step 235 corresponds to the vehicle velocity V modified by gearshift sensing G and temperature sensing T comparable to that which would appear on output 121 in FIG. 3.

At step 236, this output is multiplied by the scale factor $f_v$ for vehicle velocity and the product multiplied by the digital value stored for the desired value. This produces a result R which may be converted in the digital-analog converter at step 237 and the control of the program returns to repeat the process at 233 as indicated symbolically by the line 238. The output of 237 may be employed in the amplifier 205 of FIG. 5A to produce a signal of sufficient magnitude on line 206 to actuate the regulating element.

It will be apparent to those skilled in the art that the microprocessor of FIG. 5A may take the form of a conventional microprocessor capable of performing programmed operations of the four functions, addition, subtraction, multiplication, and division in sequential form, or, alternatively, may be configured as a special purpose microprocessor. The program disclosed in steps 230–237 may be written in a language compatible with the microprocessor selected for implementation. For example, the higher level languages, FORTRAN or the like may be used but characteristically the language may be a machine language in order to effect the well known economies in storage and speed of processing.

It will be apparent that the configuration disclosed in FIGS. 5A–B performs functions comparable to those of FIGS. 3 and 4.

While I have shown and described only four embodiments in accordance with the present invention, it is understood that the same is not limited thereto but is susceptible to numerous changes and modifications as known to one having ordinary skill in the art, and I therefore do not wish to be limited to the details shown and described herein, but intend to cover all such modifications as are encompassed by the scope of the appended claims.

What is claimed is:

1. Device for effecting fuel conservation in an automotive vehicle having an internal combustion engine comprising a throttle valve, an accelerator pedal and means controlling a transfer characteristic between the accelerator pedal and the throttle valve for effecting a progressive transfer characteristic at idling speeds wherein a large change in the accelerator pedal position effects a small change in throttle valve position which control changes to effect an increasingly degressive transfer characteristic wherein a small change in accelerator pedal position effects a large change in throttle valve position as the vehicle velocity increases to high velocity.

2. Device according to claim 1, characterized in that the means controlling the transfer characteristic is responsive to the vehicle velocity.

3. Device according to claim 2, characterized in that the means controlling the transfer characteristic can be changed with a factor associated with at least one additional variable.

4. Device according to claim 3, characterized in that an additional variable is associated with the gearshift position.

5. Device for controlling the throttle valve position or the injection pump position, respectively, of an internal combustion engine, for automotive vehicles with a gas pedal, wherein a function generator is provided which presets the correlation of the throttle valve position or injection pump position with the position of the gas pedal in accordance with a function which can be changed by a regulating and correcting variable, the regulating variable is associated with the vehicle velocity and can be changed with a factor associated with at least one further varible and an additional variable is associated with the gearshift position, and a further additional variable is associated with the roadway temperature.

6. Device according to one of claims 1–5, characterized in that the function generator is constituted by a leaf spring, one end of which is mounted to be rotatable, and the other end of which is mounted to be rotatable and axially displaceable, wherein at least one end is turned by a regulating element provided with a geared motor in dependence on the regulating variable in such a way that the leaf spring forms, depending on the flexing direction, a curve with a course running from progressive via linear to degressive, along which curve is guided the linkage between the gas pedal and the throttle valve with one of its axles.

7. Device according to one of claims 1–5, characterized in that the function generator consists of an operational amplifier, the noninverting input of which can be fed with an electrical signal associated with the gas pedal position, and from the output of which extend two parallel-connected voltage dividers, with a dividing ratio variable by the regulating value, to the reference potential of the circuit, wherein the tap of the first voltage divider is connected to the inverting input of the operational amplifier and the tap of the second voltage divider is connected to the regulating element of the throttle valve or of the injection pump, respectively.

8. Device according to claim 7, characterized in that both voltage dividers between the amplifier output and tap consist of respectively one ohmic resistor and between tap and reference potential of respectively one photosensitive resistor, on which is effective a lamp common to both, with a luminosity correlated with the regulating variable; and that a diode current-conductive toward the reference potential is connected in the first voltage divider between the photosensitive resistor and the reference potential.

9. Device according to claim 7, characterized in that there are connected in the first voltage divider, between the amplifier output and the tap, a series circuit of a first photosensitive resistor with a diode current-conductive toward the tap, and a series circuit of a second photosensitive resistor with a diode current-conductive toward the reference potential between the tap and the reference potential; that respectively one resistor is connected in parallel to both series circuits; that a first photosensitive resistor is connected in the second voltage divider between the amplifier output and the tap, and a second photosensitive resistor is connected between the tap and the reference potential; that the luminosity of a first lamp acts on the two first photosensitive resistors of both voltage dividers, and the luminosity of a second lamp acts on the two second photosensitive resistors of both voltage dividers; and that both lamps are connected on one side with each other and to an adjustable voltage $U_M$ and on the other side with respectively one diode in series connection to the input of the regulating variable, wherein the first diode is current-conductive in the direction from the first lamp to the input of the regulating variable and the second diode is current-conductive from the input of the regulating variable to the second lamp.

10. Control apparatus for one of a throttle valve and injection pump of an internal combustion engine for a vehicle having a gas pedal, comprising:

means controlling the transfer characteristic between the gas pedal and one of the throttle valve or injection pump for effecting a progressive transfer characteristic at idling speeds wherein a large change in the gas pedal position effects a small change in one of the throttle valve position and injection pump position which changes to effect an increasingly degressive transfer characteristic wherein a small change in gas pedal position effects a large change in throttle valve position as the vehicle velocity increases to a high velocity in accordance with at least a modifying function.

11. Control apparatus according to claim 10, wherein said means controlling the transfer characteristic comprises:

means to modify said transfer function in accordance with vehicle velocity.

12. Control apparatus according to claim 11, wherein said means controlling the transfer characteristic comprises:

means to modify said transfer characteristic in accordance with gearshift position.

13. Apparatus according to one of claims 10 or 11, further comprising:

a leaf spring with a first end rotatable and a second end rotatable and displaceable, second means to rotate at least one of said ends in response to said modifying function to modify the position of said leaf spring, third means to control said one of a throttle valve and injection pump in response to the position of said leaf spring.

14. Apparatus according to claim 13, wherein said third means comprises:

fourth means responsive to said gas pedal to modify said correlation in response to the position of said leaf spring.

15. Control apparatus according to claim 10, wherein said means controlling the transfer characteristic comprises:

means to modify said transfer function in accordance with gearshift position.

16. Control apparatus for one of a throttle valve and injection pump of an internal combustion engine for a vehicle having a gas pedal, comprising:

first function generator means for modifying the correlation between said one of a throttle valve or injection pump position gas pedal position in accordance with at least a modifying function, wherein said first function generator means comprises:

means to modify said correlation in accordance with roadway temperature.

17. Control apparatus for one of a throttle valve and injection pump of an internal combustion engine for a vehicle having a gas pedal, comprising:

first function generator means for modifying the correlation between said one of a throttle valve or injection pump position and gas pedal position in accordance with at least a modifying function, wherein said first function generator means comprises:

means to modify said correlation in accordance with vehicle velocity, and means to modify said correlation in accordance with roadway temperature.

18. Control apparatus for one of a throttle valve and injection pump of an internal combustion engine for a vehicle having a gas pedal, comprising:

first function generator means for modifying the correlation between said one of a throttle valve or injection pump position and gas pedal position in accordance with at least a modifying function, said first function generator means comprises:

means to modify said correlation in accordance with gearshift position, and means to modify said correlation in accordance with roadway temperature.

19. Control apparatus for one of a throttle valve and injection pump of an internal combustion engine for a vehicle having a gas pedal, comprising:

first function generator means for modifying the correlation between said one of a throttle valve or injection pump position and gas pedal position in accordance with at least a modifying function, wherein said first function generator means comprises:

means to modify said correlation in accordance with vehicle velocity, means to modify said correlation in accordance with gearshift position, and means to modify said correlation in accordance with roadway temperature.

20. Control apparatus for one of a throttle valve or injection pump of an internal combustion engine for a vehicle having a gas pedal comprising:

means for setting the correlation of said one of said throttle valve and injection pump with the position of the gas pedal, logic means controlling the transfer characteristic between the gas pedal and one of the throttle valve or injection pump for effecting a progressive transfer characteristic at idling speeds wherein a large change in the gas pedal position effects a small change in one of the throttle valve position or the injection pump position changing to effect an increasingly degressive transfer characteristic wherein a small change in gas pedal position effects a large change in one of the throttle valve position and injection pump position as the vehicle velocity increases to high velocity, in accordance with at least a first function.

21. Control apparatus according to claim 20, wherein said logic means further comprises:

means to modify said output signal in response to vehicle velocity.

22. Control apparatus according to claim 20, wherein said logic means further comprises:

means to modify said output signal in accordance with gearshift position.

23. Control apparatus according to claim 20, wherein said logic means further comprises:

means to modify said output signal in response to vehicle velocity and gearshift position.

24. Control apparatus for one of a throttle valve or injection pump of an internal combustion engine for a vehicle having a gas pedal comprising:

means for setting the correlation of said one of said throttle valve or injection pump with the position of the gas pedal, logic means for modifying said output signal in accordance with at least a first function, wherein said logic means comprises:

means to modify said output signal in response to roadway temperature.

25. Control apparatus for one of a throttle valve or injection pump of an internal combustion engine for a vehicle having a gas pedal comprising:

means for setting the correlation of said one of said throttle valve or injection pump with the position of the gas pedal, logic means for modifying said output signal in accordance with at least a first function, wherein said logic means comprises:

means to modify said output signal in response to vehicle velocity and roadway temperature.

26. Control apparatus for one of a throttle valve or injection pump of an internal combustion engine for a vehicle having a gas pedal comprising:

means for setting the correlation of said one of said throttle valve or injection pump with the position of the gas pedal, logic means for modifying said output signal in accordance with at least a first function, wherein said logic means comprises:

means to modify said output signal in response to gearshift position and roadway temperature.

27. Control apparatus according to claim 26, wherein said logic means comprises:

means to modify said output signal in response to vehicle velocity.

28. A method for controlling one of a throttle valve and injection pump of an internal combustion engine for a vehicle having a gas pedal comprising the steps of:

generating a first signal in response to a sensed desired value, generating a second signal in response to a sensed value of vehicle velocity, generating a third signal in response to a sensed value of a first function, generating a fourth signal in response to a sensed value of second function, processing said first, second, third and fourth signals to produce an output signal, and controlling the transfer characteristic between the gas pedal and one of the throttle valve or injection pump for effecting a progressive transfer characteristic at idling speeds wherein a large change in the gas pedal position effects a small change in one of the throttle valve position or injection pump position, the control changing to effect an increasingly degressive transfer characteristic wherein a small change in gas pedal position effects a large change in one of the throttle valve position or injection pump position as the vehicle velocity increases to high velocity.

29. A method for controlling as set forth in claim 28, wherein said first function is gearshift position.

30. A method for controlling one of a throttle valve and injection pump of an internal combustion engine for a vehicle having a gas pedal comprising the steps of:

generating a first signal in response to a sensed desired value, generating a second signal in response to a sensed value of vehicle is velocity, generating a third signal in response to a sensed value of a first function, generating a fourth signal in response to a sensed value of second function, processing said first, second, third and fourth signals to produce an output signal, and controlling said one of a throttle valve or injection pump in response to said output signal, wherein said first function is gearshift position and wherein said second function is roadway temperature.

31. Apparatus for controlling one of a throttle valve and injection pump of an internal combustion engine for a vehicle having a gas pedal comprising:

means for generating a first signal in response to a sensed desired value, means for generating a second signal in response to a sensed value of which is velocity, means for generating a third signal in response to a sensed value of a first function, means for generating a fourth signal in response to a sensed value of second function, microprocessor means for processing said first, second, third and fourth signals to produce an output signal, and means for controlling the transfer characteristic between the gas pedal and one of the throttle valve or injection pump for effecting a progressive transfer characteristic at idling speeds wherein a large change in the gas pedal position effects a small change in one of the throttle valve position and injection pump position, the control changing to effect an increasingly degressive transfer characteristic wherein a small change in gas pedal position effects a large change in one of the throttle valve position or injection pump position as the vehicle velocity increases to high velocity.

32. Apparatus for controlling as set forth in claim 31, wherein said first function is gearshift position.

33. Apparatus for controlling one of a throttle valve and injection pump of an internal combustion engine for a vehicle having a gas pedal comprising:

means for generating a first signal in response to a sensed desired value, means for generating a second signal in response to a sensed value of which is velocity, means for generating a third signal in response to a sensed value of a first function, means for generating a fourth signal in response to a sensed value of second function, microprocessor means for processing said first, second, third and fourth signals to produce an output signal, and means for controlling said one of a throttle valve or injection pump in response to said output signal, wherein said first function is gearshift position, and wherein said second function is roadway temperature.

34. A device for effecting fuel conservation in an automotive vehicle having an internal combustion engine with a throttle valve and an accelerator pedal comprising:

at least one lamp, means for modifying the intensity of light output from the lamp as a function of at least one of vehicle velocity, gearshift position and roadway temperature, an analog logic operator means responsive to accelerator pedal position, means sensing the light intensity of said lamp for modifying the output of the analog logic operator means to effect a progressive transfer characteristic at idling speeds wherein a large change in the gas pedal position effects a small change in throttle valve position changing to effect an increasingly degressive transfer characteristic wherein a small change in gas pedal position effects a large change in throttle valve position as the vehicle velocity increases to high velocity.

* * * * *